US006375488B1

(12) United States Patent
Noro

(10) Patent No.: US 6,375,488 B1
(45) Date of Patent: Apr. 23, 2002

(54) CONNECTOR TERMINAL FITTING AND A MANUFACTURING METHOD

(75) Inventor: Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/678,367

(22) Filed: Oct. 2, 2000

(30) Foreign Application Priority Data

Oct. 1, 1999 (JP) ..... 11-281839

(51) Int. Cl.[7] ..... H01R 41/24
(52) U.S. Cl. ..... 439/395; 439/857
(58) Field of Search ..... 439/395, 404, 439/397, 406, 943, 857, 856

(56) References Cited

U.S. PATENT DOCUMENTS 4,288,141 A * 9/1981 Leather ..... 339/97 R
4,773,875 A * 9/1988 Huiskes ..... 439/395
4,781,615 A * 11/1988 Davis et al. ..... 439/395
5,122,078 A * 6/1992 Davis et al. ..... 439/405
5,498,173 A * 3/1996 Drewanz et al. ..... 439/404
6,224,432 B1 * 5/2001 Billman ..... 439/856
6,254,440 B1 * 7/2001 Ko et al. ..... 439/857

FOREIGN PATENT DOCUMENTS

GB 2 325 793 12/1998

* cited by examiner

*Primary Examiner*—Tho D. Ta
*Assistant Examiner*—P. Nguyen
(74) *Attorney, Agent, or Firm*—Banner & Witcoff, Ltd.

(57) ABSTRACT

A connector has a reduced height housing, and a reduced risk of breaking an electric wire. Electric wires Fc are connected by gripping pressure between connecting members 46 located at tips of arm members 42 of terminal fittings 40. When the terminal fittings 40 are in an attached state with a connector housing 10, the pair of arm members 42 are aligned in a width-wise direction of a flat cable F. Consequently, the height of the connector housing 10 can be reduced. Further, when the electric wires Fc are to be connected with the terminal fittings 40, these electric wires Fc merely need to be moved in a direction at a right angle to their direction of distribution until they are gripped between the connecting members 46. When this connection takes place, a pulling force is not exerted on the electric wires Fc in a length-wise direction. Consequently, breakage of these electric wires Fc can be avoided.

18 Claims, 5 Drawing Sheets

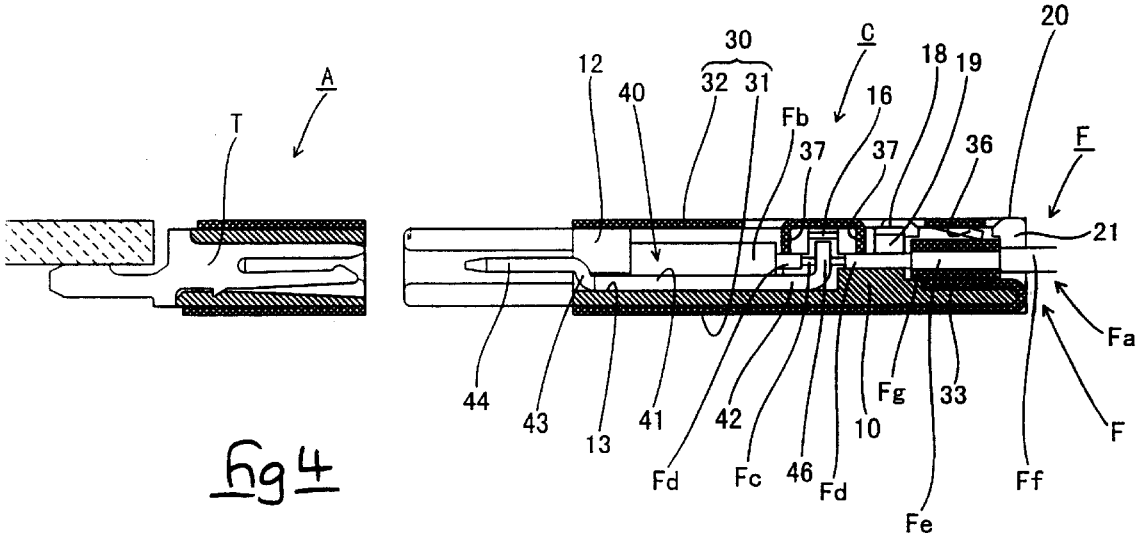
Fig 4
Fig 5
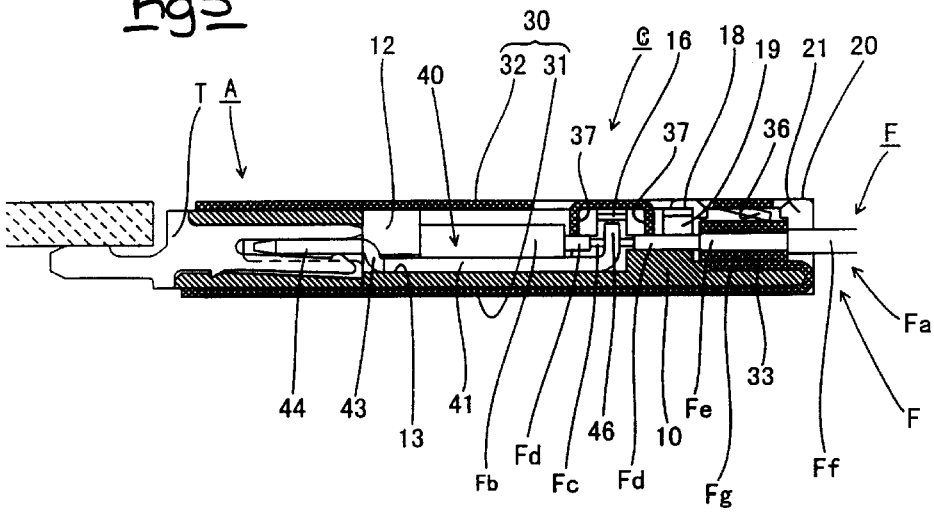

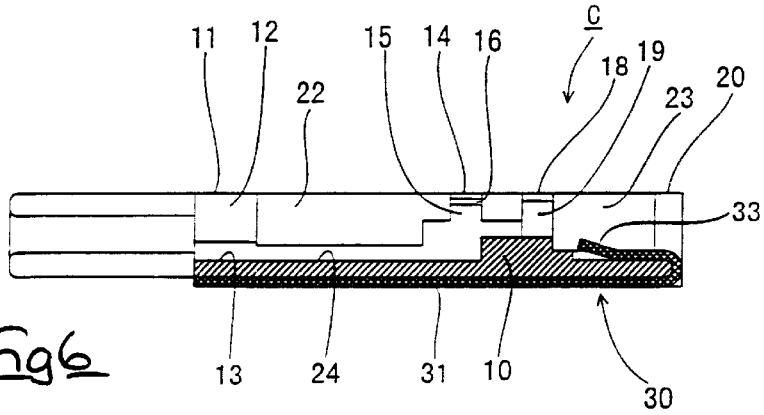
Fig6
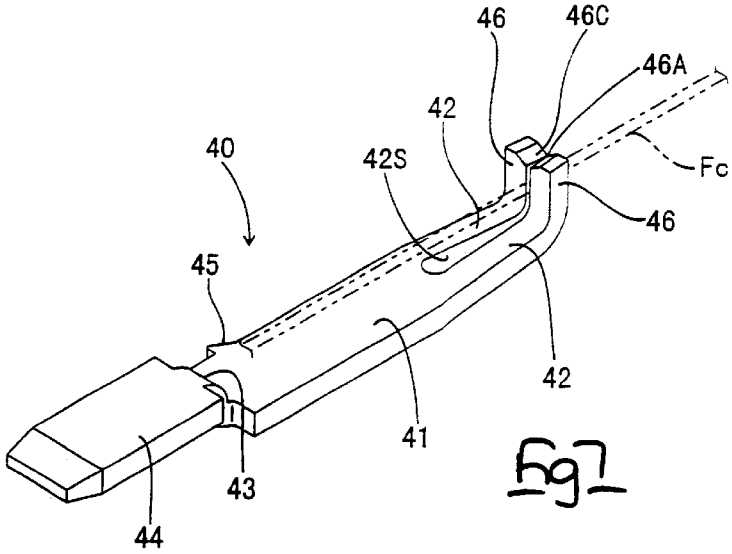
Fig7
Fig8
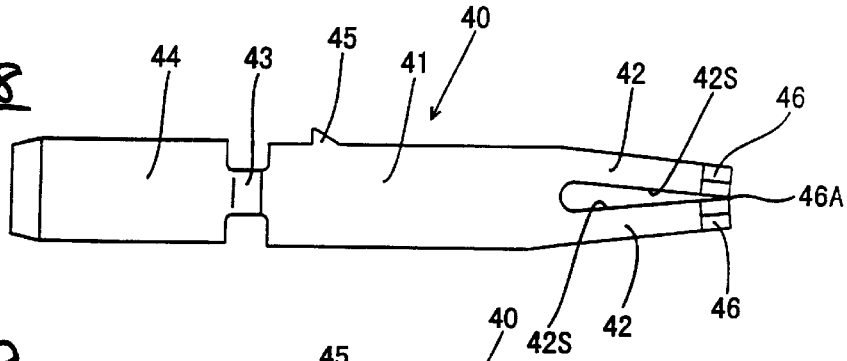
Fig9
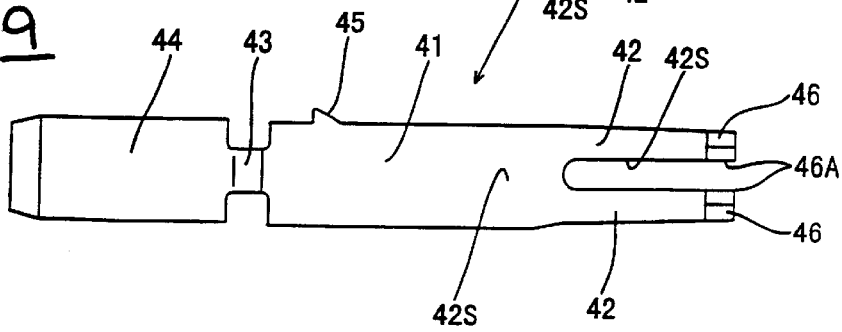

CONNECTOR TERMINAL FITTING AND A MANUFACTURING METHOD

TECHNICAL FIELD

The present invention relates to a connector for a flat cable, terminal fittings used in the connector for a flat cable, and a manufacturing method for such terminal fittings.

BACKGROUND TO THE INVENTION

An electrical connector for a flat cable is described in JP-11-26103. In this example, ends of a flat cable are housed transversely in a housing, electric wires of the flat cable are distributed in a bent-over shape along upper and lower faces of an electric wire supporting member, and a pair of upper and lower arm members provided on terminal fittings fit with the bent-over distributed portions of the electric wires so as to resiliently grip these portions of the electric wires from above and below. By this means, the electric wires and the terminal fittings are attached with a specified attaching force.

In the conventional connector, the pair of arm members gripping the electric wire supporting member are aligned within the housing in the direction corresponding to the height of the housing. As a result, there is the problem that the housing is unnecessarily thick. Furthermore, the electric wires are bent over along the electric wire supporting member, the arm members scraping against these bent-over electric wires along their length-wise direction. Consequently, there is the danger that, if the electric wires are thin, they may break when a pulling force is exerted thereon.

The present invention has taken the above problem into consideration, and aims to present a connector wherein the height of the housing is reduced, and wherein the electric wires will not break.

SUMMARY OF THE INVENTION

According to a first aspect of the invention there is provided an elongate terminal fitting for an electrical connector, said fitting comprising at one end a tab for connection to a corresponding terminal fitting, and at the other end a pair of arms extending in the direction of elongation of the terminal fitting, the ends of said arms comprising wire connection members adapted to resiliently grip an electrical wire therebetween.

Preferably the free ends of said arms are substantially at a right angle to said direction of elongation, said arms gradually approaching one another from the root to the tip thereof.

Such an arrangement enable the height of a connector into which the terminals are installed to be especially low. A plurality of such terminals may be aligned transversely in order to permit connection to a flat electrical cable having a plurality of aligned electrical wires. Since insertion of the wires can be at right angle, no pulling force is exerted on the wires during the wire insertion step, and the risk of breakage is thereby eliminated.

According to a second aspect of the invention, there is provided a method of manufacturing a terminal fitting of the kind mentioned above, the method comprising forming a blank having a pair of arms extending in the direction of elongation, bending a first arm towards said second arm beyond the limit of resilience to permanently deform said first arm, bending said first arm away from said second arm within the limit of resilience and simultaneously bending said second arm towards said first arm beyond the limit of resilience, such that the tips of said arms touch when released.

This method avoids simultaneous bending of the arms, and consequently the ends of the arms can be made to resiliently contact each other.

BRIEF DESCRIPTION OF DRAWINGS

Other features of the invention will be apparent from the following description of a preferred embodiment shown by way of example only in the accompanying drawings in which:

FIG. 4 is a cross-sectional view showing a state wherein the connector is separated from a corresponding connector.

FIG. 5 is a cross-sectional view showing a state wherein the connector is fitted with the corresponding connector.

FIG. 6 is a cross-sectional view of the housing.

FIG. 7 is a diagonal view of a terminal fitting.

FIG. 8 is a plan view of the terminal fitting.

FIG. 9 is a plan view showing the terminal fitting in the course of being manufactured.

DESCRIPTION OF PREFERRED EMBODIMENT

Figure 1:
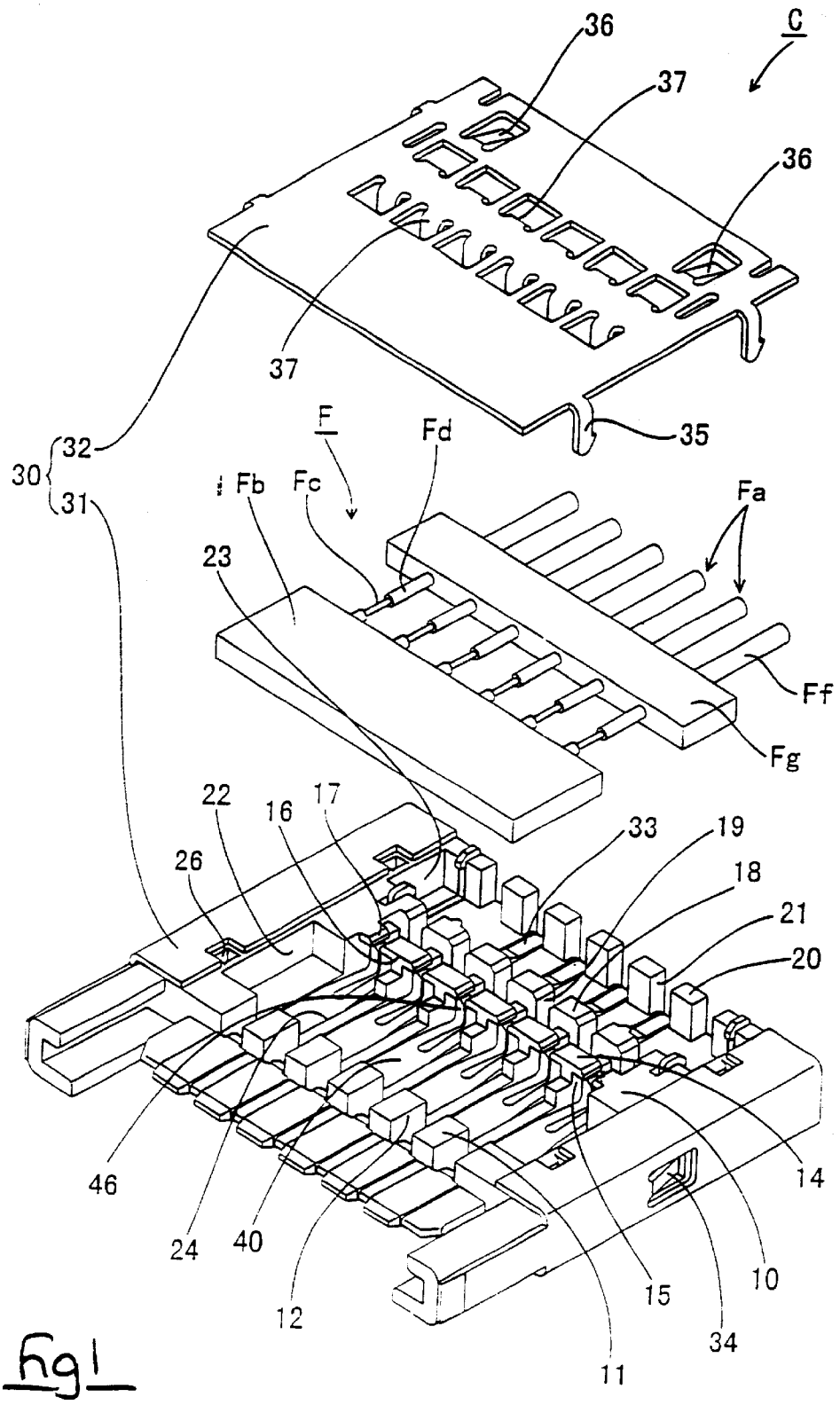
FIG. 1 is a disassembled diagonal view of a first embodiment of the invention.
Figure 2:
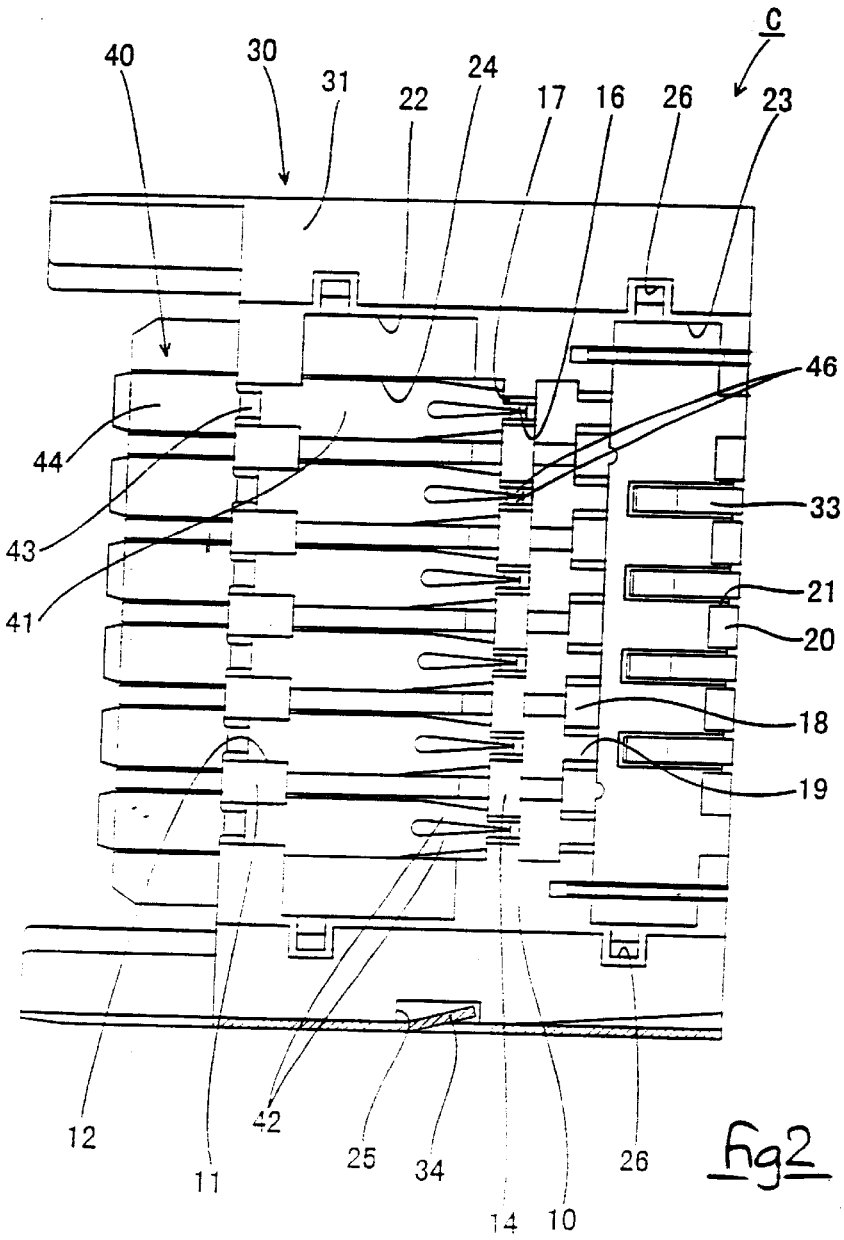
FIG. 2 is a partially cut-away plan view of a housing.
Figure 3:
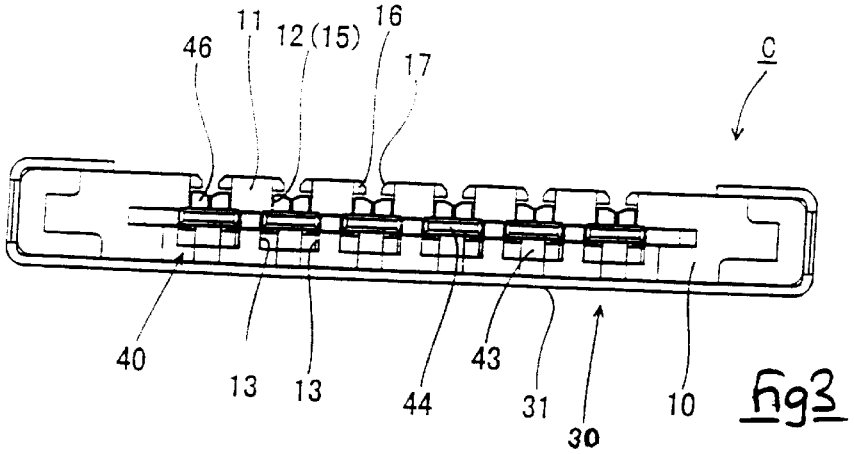
FIG. 3 is a front view of the housing.

In the present embodiment, a connector C for a flat cable fits with a corresponding connector A, and is provided with a connector housing 10 attached to a flat cable F, a plurality of terminal fittings 40, and a shielding shell 30. In the following explanation, the up-down direction is relative to FIG. 1, and FIGS. 3 to 7, the left-right direction is relative to FIG. 3, and in the anterior-posterior direction shown in FIG. 2, the left side is considered to be the anterior.

Connector Housing 10

The connector housing 10 is made from plastic, is low in height and, when seen from its upper face, is approximately square in shape, almost the entirety of this upper face being shallowly recessed. A plurality of recessed grooves 12 are aligned at the left and right at a specified pitch in an anterior end wall member 11 of the connector housing 10, these recessed grooves 12 being open upwards and in an anterior-posterior direction. A pair of guiding grooves 13 (FIG. 3) are formed so as to be opposite a lower portion of each recessed groove 12. A plurality of electric wire housing grooves 15 are formed in a first central wall 14 which is located in an approximately central position relative to the anterior-posterior direction of the connector housing 10. Each electric wire housing groove 15 corresponds to a recessed groove 12, and is open upwards and in the anterior-posterior direction. A pair of rising-prevention members 16 protrude inwards at an upper edge of each electric wire housing groove 15, and inclined guiding faces 17 for guiding electric wires Fc are formed on protruding edges of the rising-prevention members 16.

A second central wall 18 located slightly to the posterior relative to the first central wall 14 has a plurality of electric wire supporting grooves 19 formed therein. The electric wire supporting grooves 19 are aligned in a left-right direction, correspond to each electric wire housing groove 15, and are open upwards and in the anterior-posterior direction. Moreover, cable supporting grooves 21 are formed in a posterior end wall 20 of the connector housing 10, these cable supporting grooves 21 corresponding to the electric wire housing grooves 15 and the electric wire supporting grooves 19, and being open upwards and in the anterior-posterior direction. Anterior position fixing grooves 22 which open upwards are formed in left and right inner wall faces of the connector housing 10 between the anterior end wall member 11 and the first central wall 14, and posterior position fixing grooves 23 which open upwards are formed between the second central wall 18 and the posterior end wall 20. In addition, a plurality of terminal housing grooves 24 are formed in an aligned manner in an inner base face of the connector housing 10 between the anterior end wall member 11 and the first central wall 14, these terminal housing grooves 24 extending in an anterior-posterior direction between the recessed grooves 12 and the electric wire housing grooves 15.

Shielding Shell 30

The shielding shell 30 is made from a metal sheet which has been bent, and is formed from a lower shell 31 and an upper shell 32. The entirety of the lower face, the entirety of left and right side faces, and left and right edges of the upper face of the lower shell 31 extend along the connector housing 10, thereby regulating movement of the lower shell 31 in the up-down and left-right directions. A plurality of bent-over members 33 are formed at a posterior edge of the lower shell 31, the bent-over members 33 fitting with the cable supporting grooves 21 and engaging with a posterior edge of the connector housing 10, thereby regulating the movement of the lower shell 31 in an anterior direction relative to the connector housing 10. Moreover, the lower shell 31 also functions as a joining means for a conductive body Fg of the flat cable F. Furthermore, stopping members 34, which are cut into side walls of the lower shell 31, fit with grooves 25 formed on side faces of the connector housing 10, thereby regulating the movement of the lower shell 31 in a posterior direction relative to the connector housing 10.

When the lower shell 31 is in an attached state with the connector housing 10, the recessed portion of the upper face of the connector housing 10 is in a state whereby the entirety thereof is open. This is covered by attaching the upper shell 32 thereto. The entirety of the upper shell 32 has a flat sheet shape, two attachment members 35 protruding downwards from left and right side edges thereof, one attachment member 35 being located at the posterior and one attachment member 35 being located at the anterior on each side. These attachment members 35 fit into attachment holes 26 on the upper face of the connector housing 10 and are maintained in an unremoveable state therein by a retaining means (not shown). Consequently, the upper shell 32 is in an attached state with the connector housing 10 and the lower shell 31. In this attached state, a pair of left and right attaching members 36, which are cut-out and protrude downwards from lower edge portions of the upper shell 23, make resilient contact with an upper face of the conductive body Fg of the flat cable F.

A plurality of electric wire pressing members 37 are formed in the upper shell 32, these electric wire pressing members 37 being located at anterior and posterior sides so as to grip the electric wire housing grooves 15 of the first central wall 14, thus forming anterior and posterior pairs. These electric wire pressing members 37 are formed in a unified manner with the upper shell 32. They are formed by cutting out and pressing downwards portions of this upper shell 32. The electric wire pressing members 37 attach the flat cable F to the connector housing 10 and, when the upper shell 32 is in an attached state with the connector housing 10, the electric wire pressing members 37 make contact with an insulating layer Fd of the flat cable F by pressing it from above.

Terminal Fittings 40

The terminal fittings 40 are composed of sheet metal which has been punched out in a specified shape and folded. Each terminal fitting 40 is provided with a base end 41, and a pair of left and right arm members 42 which protrude in a cantilevered shape from a posterior edge of the base end 41. The base end narrows in the anterior-posterior direction, an anterior end thereof having a narrow joining member 43 joining therewith. A tab 44 is joined to an anterior end of the joining member 43, this tab 44 having the same width as the base end 41. The tab 44 is bent so as to be located in a position higher than the base end 41 and is parallel therewith. The tab 44 connects with a corresponding terminal fitting T. Furthermore, one side edge of the base end 41 has a triangular stopping protrusion 45 formed thereon.

Figure 10A:
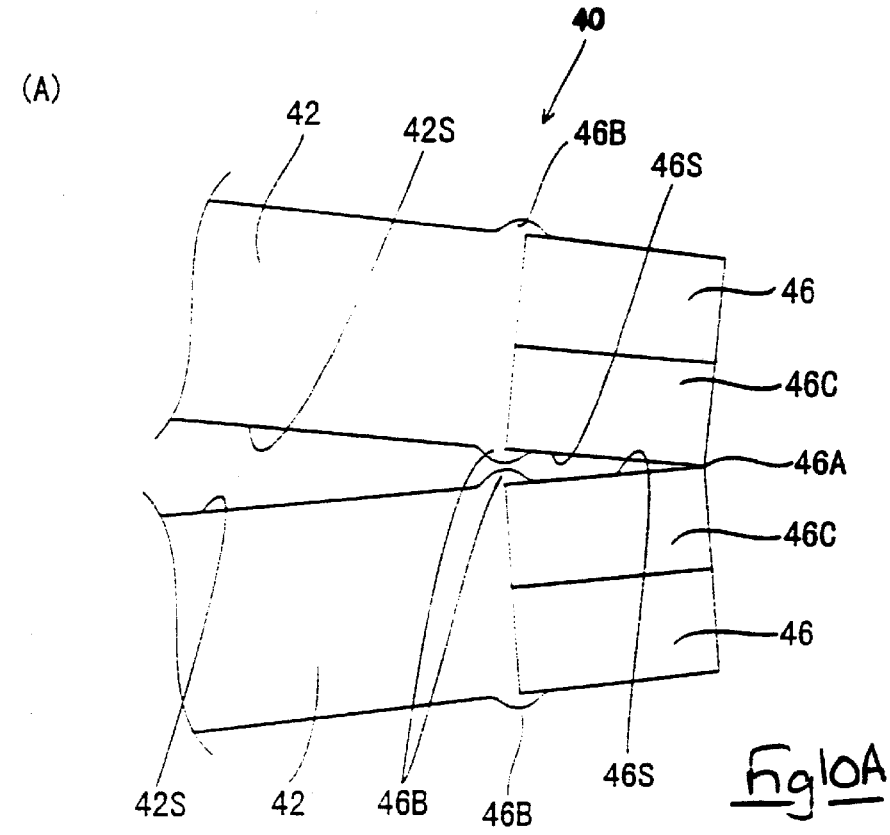
FIG. 10A is a partially expanded plan view of connecting members showing a state whereby the electric wire is not connected.
Figure 10B:
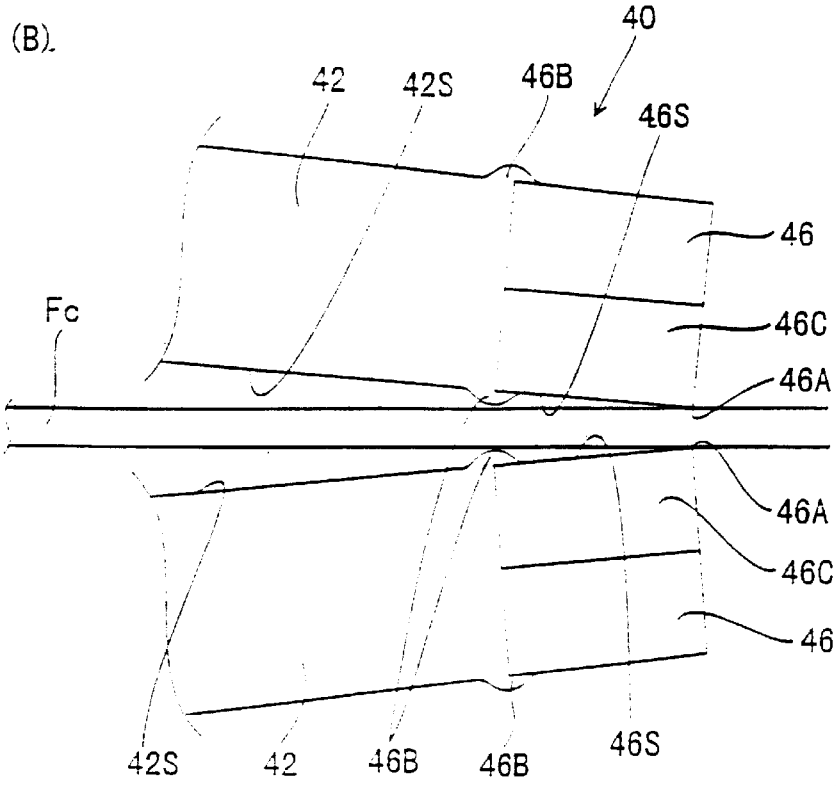
FIG. 10B is a partially expanded plan view of the connecting members showing a state whereby the electric wire is connected.

The pair of arm members 42 join with the base end 41 so as to form a unified face therewith, the arm members 42 having a specified width along their entire length up until their extending ends (posterior ends). Connecting members 46 are formed at the extending ends of the arm members 42, these connecting members 46 being formed by being bent upwards (in a direction at a right-angle to the extending direction of the arm members 42). Further, inner side faces 42S of the arm members mutually face one another and are joined with inner side faces 46S of the connecting members 46 so as to form a unified face therewith (forming a slight line when seen from above). The space between the inner side faces 42S of the arm members 42 is widest at the base ends of these arm members 42 and gradually grows narrower as it approaches the extending ends. As shown in FIG. 10A, the inner side faces 46S of the connecting members 46 have two comer edges 46A located at outermost sides of the bending portion of the connecting members 46 (the location furthermost to the posterior when viewed from above), these corner edges 46A making mutual contact. During the process whereby the connecting members 46 are bent, the walls of the innermost sides of the bending portion protrude outwards to the left and right, forming protruding members 46B. However, when the connecting members 46 are in a contacting state, (the state wherein the arm members 42 are closest together), a space is provided between the inner side faces 42S along the length of the arm members 42 and the base ends thereof, thereby preventing the protruding members 46B from mutually interfering. Moreover, inclined guiding faces 46C are formed on upper end faces of the connecting members 46, these inclined guiding faces 46C guiding the electric wire Fc between the two connecting members 46.

Flat Cable F

The flat cable F has a plurality of cables Fa, the ends of these cables Fa being maintained in position by a rectangular maintaining member Fb. The cables Fa are composed of electric wires Fc, the outer circumference thereof being covered by the insulating layer Fd. The outer circumference of the insulating layer Fd is covered by a shielding layer Fe, and this shielding layer Fe is covered by an outer cover Ff. The following removal of layers is carried out sequentially in the direction of the terminal side: the outer cover Ff and the shielding layer Fe of each cable Fa are removed, and then a portion of the insulating layer Fd is removed to expose the electric wire Fc. The maintaining member Fb surrounds and holds the insulating layer Fd which is located further towards the end (the anterior direction) relative to the exposed portion of the electric wire Fc. Furthermore, the conductive body Fg, which has an oblong sheet shape, is fixed to the exposed portion of the shielding layer Fe, this conductive body Fg causing a short-circuit between the shielding layer Fe of each cable Fa.

Attachment of the Connector C, and Connecting Process of the Flat Cable F

When the connector C is to be attached, the terminal fittings 40 and the lower shell 31 are first attached to the connector housing 10. The terminal fittings 40 are attached by pushing in these terminal fittings 40 (the connecting members 46 thereof being located towards the anterior) along the recessed grooves 12 and the guiding grooves 13 from the anterior of the connector housing 10. The connecting members 46 then enter the electric wire housing grooves 15 and posterior ends of the tabs 44 make contact with the anterior end wall member 11. At this juncture, the terminal fittings 40 are in a correctly attached state, and the stopping protrusions 45 fit into the guiding grooves 13, thereby maintaining this state in a manner whereby the terminal fittings 40 cannot be removed. Moreover, the rising-prevention members 16 and the guiding grooves 13 prevent the terminal fittings 40 from moving upwards relative to the connector housing 10. In this state, the space between the connecting members 46 is located at the lower side of the electric wire housing grooves 15.

Next, the flat cable F is set from above into the connector housing 10. At this juncture, the maintaining member Fb is fitted between the anterior end wall member 11 and the first central wall 14, the conductive body Fg is fitted between the second central wall 18 and the posterior end wall 20. The maintaining member Fb and the conductive body are fitted between the anterior position fixing grooves 22 and the posterior position fixing grooves 23 respectively and by this means the flat cable F is prevented from moving in an anterior-posterior direction and a left-right direction relative to the connector housing 10. Further, the exposed portions of the electric wires Fc are fitted into the electric wire housing grooves 15 between the first central wall 14 and the second central wall 18, and are gripped between the connecting members 46 of the terminal fittings 40, the electric wires Fc and the terminal fittings 40 being in a state of contact whereby they maintain a specified contacting pressure due to the resilient force of the arm members 42. Portions of the cables Fa to the posterior of the conductive body Fg are fitted within the cable supporting grooves 21, thereby preventing their movement in the left-right direction. A lower face of the conductive body Fg makes contact with the bent-over members 33*b* of the lower shell 31, the shielding layer Fe of each cable Fa thereby forming a circuit with the lower shell 31 via the conductive body Fg.

Next, the upper shell 32 is attached to the connector housing 10. This attachment may be performed by inserting the attachment members 35 from above into the attachment holes 26 so as to cover the upper face of the connector housing 10. When the upper shell 32 is attached, the resilient attaching members 36 make resilient contact with an upper face of the conductive body Fg of the flat cable F, the upper shell 32 and the shielding layer Fe, thereby reaching a conducting state. Moreover, locations in the immediate vicinity of anterior and posterior ends of the electric wires Fc which are connected by the connecting members 46 of the terminal fittings 40 are pressed from above by the electric wire pressing members 37 which form anterior and posterior pairs on the upper shell 32. By this means, the electric wires Fc are prevented from moving upwards, and the connecting state of the electric wires Fc and the terminal fittings 40 can reliably be maintained. The attachment of the connector A and the connecting operation of the flat cable F is thereby completed.

Manufacturing Process for the Terminal Fittings 40

When the terminal fittings 40 are to be manufactured, a metal sheet is first punched out in a specified shape, that is, in a shape whereby the pair of arm members 42 are mutually parallel (a shape whereby the space between the inner side faces 42S of the arm members 42 maintains a specified dimension from the base ends to the extending ends). The extending ends of the arm members 42 of this metal sheet are bent to form the connecting members 46 (see FIG. 9). Next, one of the two arm members 42 is resiliently bent away from the second arm member 42 (in a left-right direction), and the second arm member 42 is resiliently bent towards the first arm member 42. At this juncture, the first and second arm members 42 are moved beyond the point where they would make contact (i.e., at a central position relative to the left and right). That is, the arm members 42 are resiliently moved to a greater extent than required to anticipate their springing back. By this means, the resiliently movable arm members 42 and the connecting members 46 can be formed in the correct shape. After this, the other arm member 42 is also resiliently moved in a similar manner to a greater extent than required, in anticipation of its springing back. By this means, both connecting members 46 are reliably brought to a connecting state. Furthermore, the connecting force of the connecting members 46 when the electric wires Fc are not in a connected state can reliably be set by altering the degree of resilient movement.

When the terminal fittings 40 are attached to the connector housing 10, the pairs of arm members 42 are aligned in a width-wise direction relative to the flat cable F (the arm members extend in the direction of distribution of the electric wires Fc). The connecting members 46 at the extending ends of the arm members 42 extend upwards relative to the arm members 42, into the area where the electric wires Fc are located. These electric wires Fc are maintained, by gripping pressure, in a contacting state between the connecting members 46. Consequently, the flat cable F within the connector housing 10 can be small in dimension in the up-down direction (the direction at a right angle to its width-wise direction), and the height thereof is low. Further, when the electric wires Fc are to be connected to the terminal fittings 40, these electric wires Fc merely need to be moved at a right angle to their direction of distribution until they are gripped between the connecting members 46. Consequently, a pulling force is not exerted in a length-wise direction on the electric wires Fc, and breakage of these electric wires Fc is thus avoided.

In order to ensure that the contacting pressure of the electric wires Fc within the connecting members 46 is adequate, a configuration is desirable whereby the connecting members 46 make contact when these electric wires Fc are in a non-contacting state. On the one hand, the simplest possible configuration for ensuring that the arm members 42 are located outside the electric wire distribution path and the connecting members 46 are located within the electric wire distribution path is to bend the connecting members 46 relative to the arm members 42. However, when the connecting members 46 are bent, the walls of the innermost sides of the bending portion protrude outwards relative to the width-wise direction of the arm members 42, the protruding members 46B formed thereby mutually interfering. As a result, the arm members 42 and the inner side faces 42S and 46S of the connecting members 46 cannot be brought close together from their base ends to their extending ends. In the present embodiment, the connecting members 46 are bent in a direction at approximately right angles to the extending direction of the arm members 42. The inner side faces 42S of these arm members 42 mutually face one another, and gradually draw closer together form the base ends to the extending ends. When the electric wires Fc are in a non-contacting state, the inner side faces of the arm members 42 make mutual contact via the comer edges 46A at the outermost sides of the bending portion of the connecting members 46. Consequently, as a result of the bending operation, the protruding members 46B do not mutually interfere, and the comer edges 46A at the outermost sides of the bending portion of the connecting members 46 make contact.

In the case where the arm members 42, which extend in a long and narrow manner, are bent resiliently in a gooseneck shape, the extending ends of the arm members 42 return slightly, due to springing back, from the position to which they have been bent. As a result, the connecting members 46 cannot be made to make mutual contact by simultaneously bending the pair of arm members 42. However, according to the manufacturing method of the present embodiment, when the second of the two arm members 42 is bent resiliently, the first arm member 42 is bent in a direction of separation therefrom. Consequently, the arm members 42 can be bent to a greater extent than required to anticipate their springing back, and the connecting members 46 are reliably brought into the contacting state.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the explanation is for a shielded connector. However, the present invention is equally suitable for connectors which are not of the shielded type.

(2) In the embodiment described above, the connecting members are formed by bending the extending ends of the arm members. However, according to the present invention, it is equally possible to cut out arm members having L-shaped tips, these L-shaped tip portions serving as the connecting members.

(3) In the embodiment described above, only the connecting members at the extending ends of the inclined arm members make contact. However, according to the present invention, contact may equally well be made along a longer range of the arm members.

(4) In the embodiment described above, the connecting members have been bent upwards. However, according to the present invention, the connecting members may equally well be bent inwards.

(5) In the embodiment described above, the arm members are thick in the up-down direction. However, according to the present invention, the arm members may equally well be thick in the left-right direction.

(6) In the embodiment described above, a case has been explained whereby the terminal fittings connect with corresponding terminal fittings. However, the present invention is equally suitable for a case whereby the terminals are joint terminals connecting with other electric wires that constitute a flat cable.

What is claimed is:

1. An elongate terminal fitting for an electrical connector, said fitting comprising a base portion connected at one end to a tab for connection to a corresponding terminal fitting, and connected at the other end to a pair of arms having elongate arm portions extending longitudinally in the direction of elongation of the terminal fitting, the ends of said arms comprising wire connection members adapted to resiliently grip an electrical wire therebetween, wherein a root region is defined where said pair of arms are connected to said base portion, and said pair of arms having inside surfaces that converge toward and into contact with one another from said root region to said ends of said arms, and said wire connection members of said arms are substantially at a right angle to said arm portions and said direction of elongation, said arms gradually approaching one another from a root region where said arm portions are connected to said base portion to tips of said arms.

2. A terminal fitting according to claim 1 wherein said arms are urged resiliently against one another at the tips only.

3. A terminal fitting according to claim 2 wherein said arms make substantially a line contact only at the tips thereof.

4. A terminal fitting according to claim 1 wherein said arms make substantially a line contact only at the tips thereof.

5. A terminal fitting according to claim 1 wherein said fitting has a relatively narrow waist between said tab and arms.

6. A terminal fitting according to claim 5 wherein said tab and arm portions extend in mutually parallel planes, the transition between said planes being at said waist.

7. A terminal fitting according to claim 1 and having a one-way latching projection at the side thereof, said projection having a ramp face and a substantially orthogonal latching face.

8. An electrical connector having a plurality of terminal fittings according to claim 1, said terminal fittings being aligned transversely and being adapted to receive a flat cable having a plurality of aligned electrical wires, one each of said wires being grippable between a respective pair of wire connection members, and said elongate arm portions and said flat cable defining generally mutual parallel planes.

9. An elongate terminal fitting for an electrical connector, said fitting comprising a base portion connected at one end to a tab for connection to a corresponding terminal fitting, and connected at the other end to a pair of arms having elongate arm portions extending longitudinally in the direction of elongation of the terminal fitting, the ends of said arms comprising wire connection members adapted to resiliently grip an electrical wire therebetween, wherein at least one of said arms is biased and urged resiliently toward and against the other of said arms, and said wire connection members of said arms are substantially at a right angle to said arm portions and said direction of elongation, said arms gradually approaching one another from a root region where said arm portions are connected to said base portion to tips of said arms.

10. A terminal fitting according to claim 9 wherein each said arm has a tip at distal end thereof, and the arms are biased toward one another so that the arms are urged resiliently against one another at only the tips.

11. A terminal fitting according to claim 10 wherein said arms make substantially a line contact only at the tips thereof.

12. A terminal fitting according to claim 9 wherein said arms are biased toward one another so that said arms are urged resiliently against one another at the tips only.

13. A terminal fitting according to claim 12 wherein said arms make substantially a line contact only at the tips thereof.

14. A terminal fitting according to claim 9 wherein said fitting has a relatively narrow waist between the tab and the arms.

15. A terminal fitting according to claim 14 wherein the tab and the arms extend in mutually parallel planes, the transition between said planes being at said waist.

16. An elongate terminal fitting for an electrical connector, said fitting comprising a base portion connected at one end to a tab for connection to a corresponding terminal fitting, and connected at the other end to a pair of arms having elongate arm portions extending longitudinally in the direction of elongation of the terminal fitting, the ends of said arms comprising wire connection members adapted to resiliently grip an electrical wire therebetween, wherein a root region is defined where said pair of arms are connected to said base portion, and said pair of arms having inside surfaces that converge toward and into contact with one another from said root region to said ends of said arms; and wherein said fitting has a relatively narrow waist between said tab and arms, and wherein said tab and arm portions extend in mutually parallel planes, the transition between said planes being at said waist.

17. An electrical connector having a plurality of elongate terminal fittings, each of said fittings comprising a base portion connected at one end to a tab for connection to a corresponding terminal fitting, and connected at the other end to a pair of arms having elongate arm portions extending longitudinally in the direction of elongation of the terminal fitting, the ends of said arms comprising wire connection members adapted to resiliently grip an electrical wire therebetween, wherein a root region is defined where said pair of arms are connected to said base portion, and said pair of arms having inside surfaces that converge toward and into contact with one another from said root region to said ends of said arms; and wherein said plurality of terminal fittings are aligned transversely and are adapted to receive a flat cable having a plurality of aligned electrical wires, one each of said wires being grippable between a respective pair of wire connection members, and said elongate arm portions and said flat cable defining generally mutually parallel planes.

18. An elongate terminal fitting for an electrical connector, said fitting comprising a base portion connected at one end to a tab for connection to a corresponding terminal fitting, and connected at the other end to a pair of arms having elongate arm portions extending longitudinally in the direction of elongation of the terminal fitting, the ends of said arms comprising wire connection members adapted to resiliently grip an electrical wire therebetween, wherein at least one of said arms is biased and urged resiliently toward and against the other of said arms, and wherein said fitting has a relatively narrow waist between the tab and the arms, and the tab and the arms extend in mutually parallel planes, the transition between said planes being at said waist.

* * * * *